US006036054A

United States Patent [19]

Grill

[11] Patent Number: 6,036,054

[45] Date of Patent: Mar. 14, 2000

[54] ATTACHMENT ADAPTED FOR A CARBONATED LIQUID CONTAINER

[75] Inventor: Benjamin Grill, Woodland Park, Colo.

[73] Assignee: Sturman BG, LLC, Woodland Park, Colo.

[21] Appl. No.: 09/083,747

[22] Filed: May 22, 1998

[51] Int. Cl.[7] ..... B67D 5/00

[52] U.S. Cl. ..... 222/3; 222/5; 222/399; 141/64; 261/DIG. 7

[58] Field of Search ..... 222/1, 3, 5, 399; 141/19, 64; 261/DIG. 7

[56] References Cited

U.S. PATENT DOCUMENTS

| | | | |
|---|---|---|---|
| 5,022,565 | 6/1991 | Sturman et al. | 222/5 |
| 5,329,975 | 7/1994 | Heitel | 261/DIG. 7 |
| 5,395,012 | 3/1995 | Grill et al. | 222/5 |
| 5,396,934 | 3/1995 | Moench | 141/64 |
| 5,458,165 | 10/1995 | Liebmann, Jr. | 141/64 |
| 5,487,850 | 1/1996 | Vanderploeg | 261/DIG. 7 |

*Primary Examiner*—Joseph A. Kaufman

*Attorney, Agent, or Firm*—Blakely, Sokoloff, Taylor & Zafman LLP

[57] ABSTRACT

The present invention is an attachment that can pressurize a beverage container with carbon dioxide or other suitable pressurized gaseous fluid. The attachment has a first threaded opening that can be screwed onto the container and a second opening which can be coupled to either a pressurized gas cartridge or a pressurized gas tank. Extending from the carbonator is a button that is coupled to a valve which controls the flow of gas into the container. The button and valve are coupled to a spring that functions as a regulator which controls the gas pressure within the container. When the button is depressed, the valve is opened and gas flows into the container until the gas pressure overcomes the spring force and closes the valve. Varying the displacement of the button varies the spring force and the gas pressure within the container. The user can thus vary and control the gas pressure of the container by manipulating the button.

8 Claims, 3 Drawing Sheets

ATTACHMENT ADAPTED FOR A CARBONATED LIQUID CONTAINER

BACKGROUND OF THE INVENTION

1. Field of the Invention

The present invention relates to an apparatus that can carbonate liquids within a container.

2. Description of Related Art

Carbonated water and sodas are typically packaged in glass or plastic bottles. When shipped, the bottles are usually sealed with a cap or top that can be subsequently removed. After the seal is broken, the carbon dioxide escapes from the bottle. Over time, the carbonated beverage loses most of its carbonation, resulting in a drink that tastes"flat". The release of carbon dioxide from the carbonated beverage therefore limits the amount of time that an opened bottle of such beverage can be kept and reused. It is desirable to recarbonate a carbonated beverage to restore its taste.

U.S. Pat. No. 5,022,565, issued to Sturman et al. on Jun. 11, 1991, U.S. Pat. No. 5,395,012, issued to Grill et al. on Mar. 7, 1995 and U.S. Pat. No. 5,443,186, issued to Grill on Aug. 22, 1995, disclose devices that can be attached to beverage containers. These devices contain a carbon dioxide ($CO_2$) cartridge which can supply carbon dioxide to the contents of the container. The flow of $CO_2$ into the container is controlled by a flow valve that is actuated by a button or lever located on the side of the device. The flow valve is constructed to regulate the pressure of $CO_2$ within the beverage container.

The $CO_2$ cartridge of the above devices can be removed and replaced when the cartridge has been depleted. A typical $CO_2$ cartridge can provide a limited number of charges of $CO_2$, after which the cartridge must be replaced. Having to periodically replace the cartridges can be expensive and inconvenient to the user. It would be desirable to have a carbonation attachment that can be supplied with $CO_2$ from either a cartridge or a large tank. Coupling the attachment to a $CO_2$ tank would allow the user to recharge a large number of beverage containers before replacing the tank.

SUMMARY OF THE INVENTION

The present invention is a versatile attachment that can pressurize a container with a pressurized gaseous fluid, such as carbon dioxide ($CO_2$). The attachment has a first threaded opening that can be screwed onto the container and a second opening which can be coupled to either a $CO_2$ cartridge or a $CO_2$ tank. Extending from the carbonator is a button that is coupled to a valve which controls the flow of gas into the container. The button and valve are coupled to a spring that functions as a regulator which controls the gas pressure within the container. When the button is depressed, the valve is opened and gas flows into the container until the gas pressure overcomes the spring force and closes the valve. Varying the displacement of the button varies the spring force and the gas pressure within the container. The user can thus vary and control the gas pressure of the container by manipulating the button.

BRIEF DESCRIPTION OF THE DRAWINGS

The objects and advantages of the present invention will become more readily apparent to those skilled in the art after reviewing the following detailed description and accompanying drawings, wherein.

DETAILED DESCRIPTION OF THE INVENTION

Figure 1:
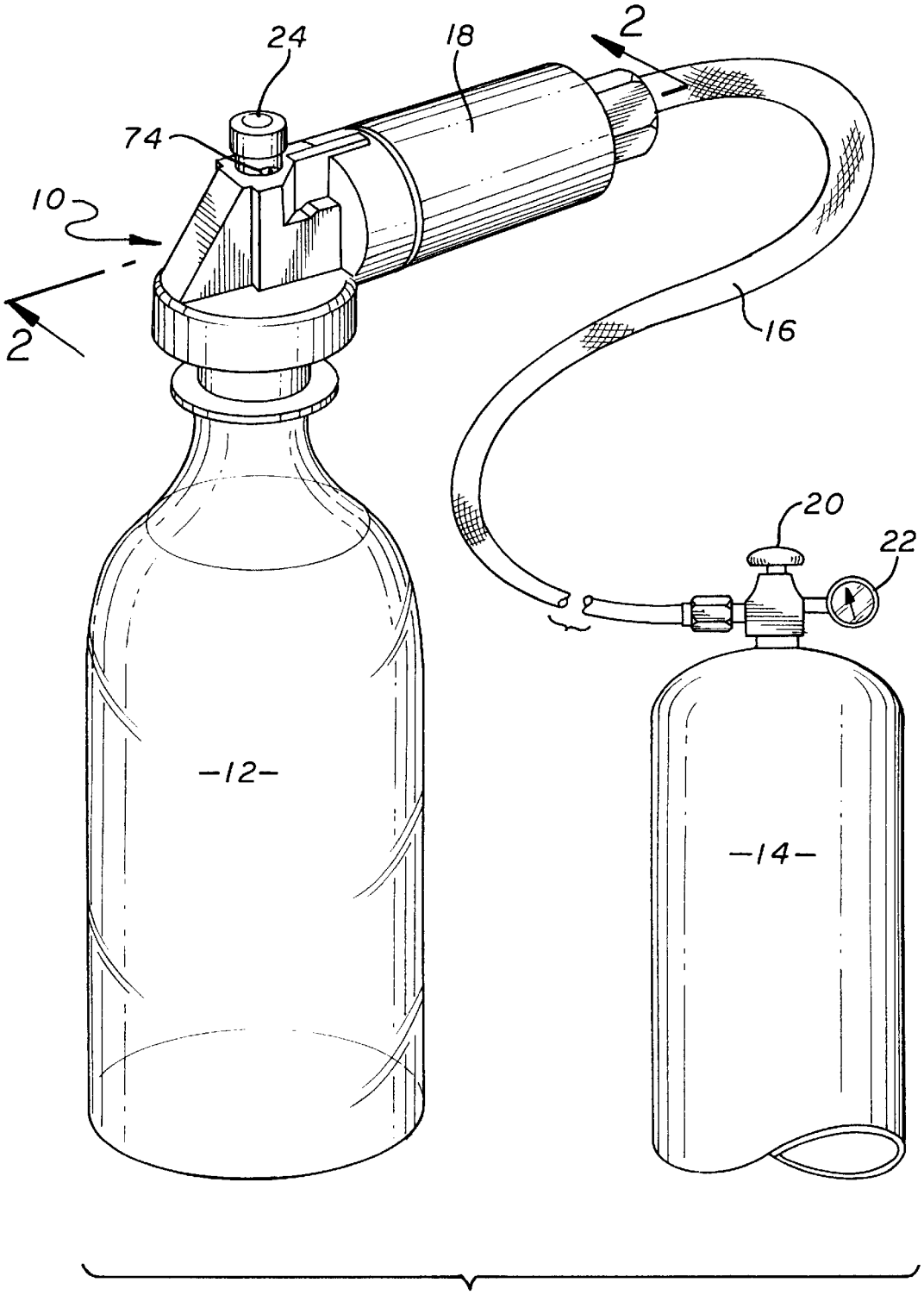
FIG. 1 is a perspective view of a carbonator attachment of the present invention attached to a container and coupled to a tank through an adapter.

Referring to the drawings more particularly by reference numbers, FIG. 1 shows a carbonator attachment 10 of the present invention attached to a container 12 that holds a beverage. Although the beverage described hereafter is a soft drink, it is to be understood that the container can hold any beverage or liquid for which carbonation is desired. For example, other suitable beverages may be water or beer. The container 12 is typically a bottle formed from a plastic such as polyethylene terephthalate (PET), but can also be a glass bottle or any other container suitable for holding a beverage or liquid.

The carbonator 10 is coupled to a tank 14 of pressurized carbon dioxide ($CO_2$) by a flexible hose 16 and an adapter 18. The tank 14 may have a shut-off valve 20 and a pressure gauge 22 attached thereto. The carbonator 10 has a movable button 24 which can be depressed to release $CO_2$ from the tank 14 into the container 12. The attachment 10 is used to carbonate or re-carbonate the contents of the container 10 with carbon dioxide.

Figure 2:
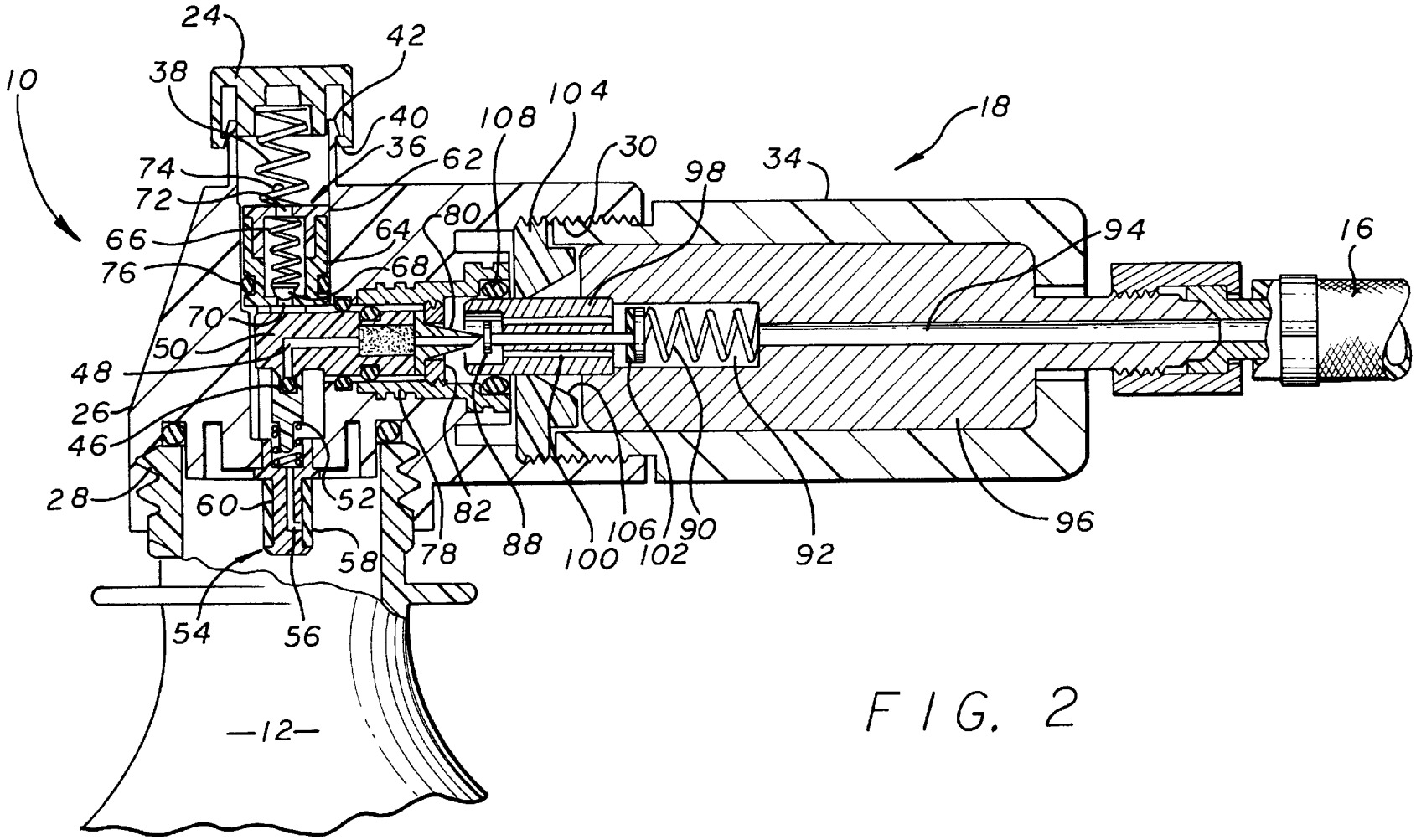
FIG. 2 is a cross-sectional view of the attachment taken along line 2—2 of FIG. 1.
Figure 4:
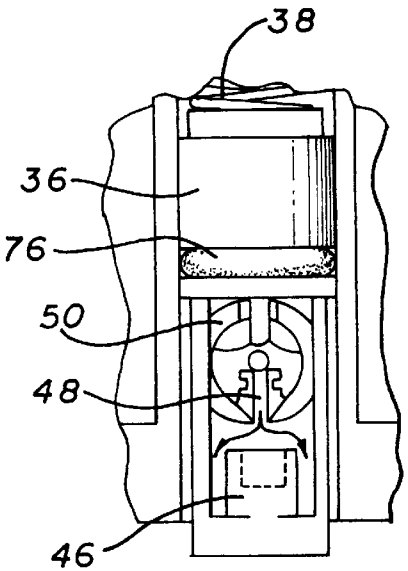
FIG. 4 is a cross-sectional view showing a regulator valve of the attachment.
Figure 3:
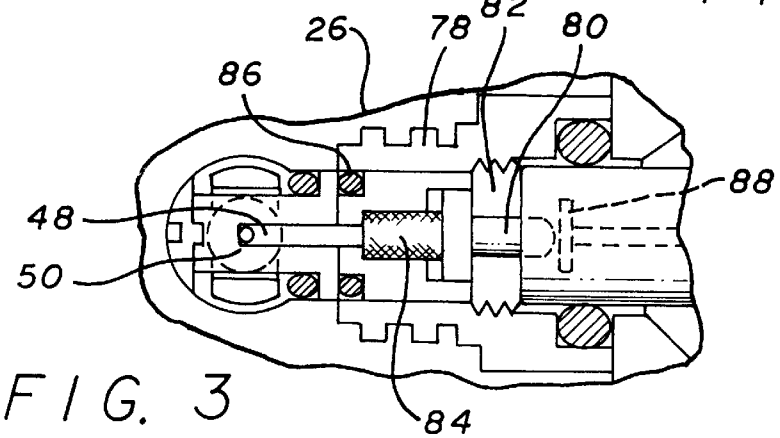
FIG. 3 is a cross-sectional view of the attachment showing an adapter valve.

FIGS. 2–4 show the various components of the attachment 10 and the adapter 18. The attachment 10 has a housing 26 with a first thread 28 that can be screwed onto the container 12 and a second thread 30 that can receive corresponding threads 32 of an outer casing 34 of the adapter 18.

The button 24 is coupled to a regulator piston valve 36 by a compression spring 38. The spring 38 moves the button back to its original position when the button 24 is released by the user. The button 24 has an inner annular lip 40 which is captured by an outer annular lip 42 that extends from the housing 26. The lips 40 and 42 cooperate to limit the movement of the button in the direction away from the housing 26.

The regulator piston valve 36 has a valve seat 46 coupled to the valve passage 48 of regulator valve housing 50. The valve seat 46 is biased into a closed position by a regulator spring 52. The regulator spring 52 is seated within one-way valve housing member 54. The housing member 54 has an outlet passage 56 that is covered by one way valve 58. The one-way valve 58 is preferably a rubber band that is positioned within an outer annular groove 60 of the housing member 54. The one-way valve 58 allows gas to flow from the attachment into the container 12, but prevents a reverse flow from the container 12 into the outlet passage 56.

Depressing the button 24 compresses the spring 38 and moves the regulator piston valve seat 46 into an open position. When the seat 46 is in the open position, gas can flow from the one-way valve 56 and into the container 12. The valve seat 46 moves back into the closed position when the gas pressure and the force of the regulator spring 52 are greater than the force of the spring 38. The attachment therefore has a built in regulator which prevents the overpressurization of the container 12. The gas pressure within the container can be varied by changing the amount of displacement of the button 24 and changing the force applied by the spring 38 to the valve 36.

The regulator valve assembly 36 includes an upper valve member 62 and a lower valve member 64 which capture a pressure relief spring 66. The spring 66 is coupled to a ball 68 which is seated on valve opening 70. The valve 44 also has an opposite opening 72. The ball 68 becomes unseated when the gas pressure exceeds the force of the relief spring 66, wherein the gas can flow through the openings 70 and 72 and out of the attachment 10 through an opening 74 in the housing 26. The ball 68 and spring 66 provide a back-up pressure relief valve which prevents overpressurization of the container 12. The attachment may also have an O-ring 76 which seals the valve 36 to the housing 26.

As shown in FIG. 3, the regulator housing 50 is located within an insert 78 that is attached to the housing 26. A tubular piercer 80 is coupled to the regulator housing 50 and held in place by a nut 82 that is threaded into the insert 78. Adjacent to the piercer 80 is a stainless steel filter 84 which filters out impurities flowing into the attachment 10. The insert 78 is sealed to the regulator valve 50 by O-ring 86.

The adapter 18 has a plunger 88 which is biased into a closed position by plunger spring 90. The spring 90 is located within a spring chamber 92 that is in fluid communication with an adapter passage 94 which extends through an adapter housing 96. Attached to the adapter housing 96 is an adapter valve housing 98 which has a number of passages 100. The plunger 88 has a valve seat 102 which covers the passages 100 when in the closed position.

To introduce gas to the attachment 10 from the $CO_2$ tank 14, the shell 34 is screwed into the attachment housing 26. Inserting the adapter 18 causes the plunger 88 to engage the needle 80 and push the valve seat 102 away from the valve housing 98. Moving the valve seat 102 allows gas to flow through the passages 100 and into the passage 48 of the regulator housing 50. The gas can be released into the container by depressing the button 24. The attachment may have a second insert 104 which has a chamfered surface 106 that leads the adapter housing 96 into the piercer 80. The attachment may also have an O-ring 108 which seals the adapter 18 to the insert 78.

Figure 5:
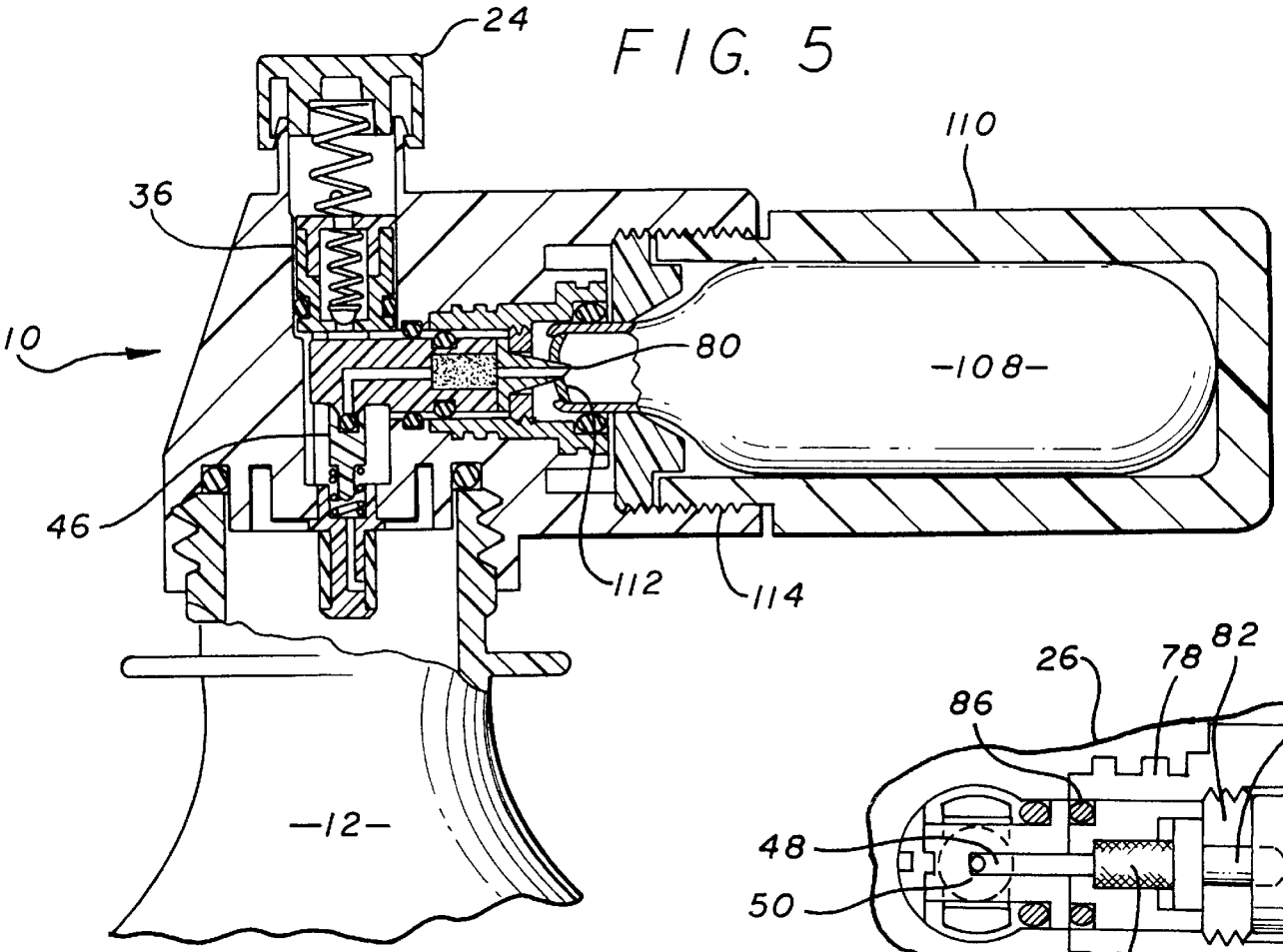
FIG. 5 is a cross-sectional view showing a pressurized gaseous fluid cartridge coupled to the attachment.

As shown in FIG. 5, the adapter 18 can be removed and a pressurized $CO_2$ cartridge 108 can be installed into the attachment 10. The cartridge 108 is typically housed within a cartridge housing 110 and has a rubber seal 112 which is punctured by the piercer 80 to allow gas to flow into the attachment 10. The cartridge housing 110 has threads 114 that allow the housing to be readily assembled to the attachment 10.

The attachment of the present invention provides a button-actuated pressure regulated carbonator which can be coupled to either a $CO_2$ cartridge or a $CO_2$ tank. The attachment thus provides the end user the option of using a cartridge, which is small and less cumbersome to use, or a tank which will provide a larger reservoir of carbon dioxide.

While certain exemplary embodiments have been described in detail and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. An attachment assembly operable to pressurize a container and adapted to be coupled to a cartridge that contains a pressurized gaseous fluid or a tank that contains a gaseous fluid, comprising:

a housing defining a first opening that is adapted to be coupled to the container and a second opening adapted to be coupled to the cartridge;

a valve operatively connected to said second opening, said valve operable to move between a closed position and an open position, such that said valve allows gas to flow from said second opening to said first opening and into the container when in an open position;

a button operable to move relative to said housing and is operatively connected to said valve to move said valve from said closed position to said open position;

a variable regulator that can move said valve and said button from said open position to said closed position when gas pressure within the container reaches a first predetermined level, said variable regulator being constructed to allow a variation in the first predetermined pressure level by moving said buttons;

a piercer coupled to said housing and adapted to pierce the cartridge; and, an adapter adapted to be coupled to said second opening and the tank, said adapter having a plunger engageable with said piercer so that gas flows from the tank to said valve when said adapter is coupled to said second opening.

2. The attachment of claim 1, wherein said variable regulator means is operatively connected to said button such that said first predetermined pressure level can be varied by varying said movement of said button.

3. The attachment of claim 2, wherein said variable regulator includes a pressure relief valve that allows said gas to flow into the ambient when said gas pressure within the container reaches a second predetermined pressure level greater than said first predetermined pressure level.

4. The attachment of claim 2, wherein said variable regulator includes a second spring that couples said valve to said button, said second spring provides a spring force on said valve and biases said valve into said open position when said button is moved a predetermined distance, wherein said first predetermined pressure level can be varied by moving said button.

5. The attachment of claim 1, wherein said variable regulator includes a first spring operable to bias said valve towards said closed position.

6. An attachment assembly adapted to pressurize a container and adapted to be coupled to a cartridge that contains a pressurized gaseous fluid, or a tank that contains a pressurized gaseous fluid, comprising:

a housing defining a first threaded opening and a second threaded opening;

a piercer positioned within said second opening;

a valve operatively connected to said piercer, said valve being adapted to move between a closed position and an open position, such that said valve allows said gas to flow into said first opening and into the container when in an open position;

a first spring connected to said valve and operable to bias said valve into said closed position;

a button movable relative to said housing and operatively connected to said valve to move said valve from its closed position to its open position;

a second spring connected to said button and said valve, said second spring providing a spring force on said valve and biasing said valve into its open position when said button is moved a predetermined distance, said valve movable from its open position to its closed position when said gas pressure within the container reaches a first predetermined pressure level, wherein said first predetermined pressure level can be varied by moving said button and, an adapter connected to the tank, said adapter having a plunger engageable with said piercer so that gas is released into said valve from the tank when said adapter is mounted to said second opening, said piercer also being adapted to penetrate the cartridge so that gas is released from the cartridge to said valve.

7. The attachment of claim 6, wherein said variable regulator means includes a pressure relief valve that allows said gas to flow into the ambient when said gas pressure within the container reaches a second predetermined pressure level greater than said first predetermined pressure level.

8. A method of carbonating a liquid within a container, comprising the steps of:

attaching a first opening of an attachment housing to the container, said attachment housing having a button-controlled regulator piston valve and a second opening;

attaching an adapter to the second opening; and, attaching a tank of pressurized gaseous fluid to said adapter.

* * * * *